US006659863B2

(12) United States Patent
Ashley et al.

(10) Patent No.: US 6,659,863 B2
(45) Date of Patent: Dec. 9, 2003

(54) METHOD OF PLAYING A POKER GAME WITH CARD BACK HANDS

(75) Inventors: Stephen Eugene Ashley, Belvidere, IL (US); Kristine Marie Ashley, Belvidere, IL (US)

(73) Assignee: Card Back Gaming Corporation, Belvidere, IL (US)

( * ) Notice: Subject to any disclaimer, the term of this patent is extended or adjusted under 35 U.S.C. 154(b) by 0 days.

(21) Appl. No.: 09/776,993

(22) Filed: Feb. 5, 2001

(65) Prior Publication Data

US 2002/0107063 A1 Aug. 8, 2002

(51) Int. Cl.[7] ..... A63F 13/00

(52) U.S. Cl. ..... 463/13; 463/16; 273/292; 273/296

(58) Field of Search ..... 463/11, 12, 13; 273/292, 138.1, 139

(56) References Cited

U.S. PATENT DOCUMENTS 5,106,100 A * 4/1992 Yih ..... 273/292
5,332,219 A * 7/1994 Marnell et al. ..... 463/13
5,332,228 A * 7/1994 Schultz ..... 463/13
5,531,440 A * 7/1996 Dabrowski et al. ..... 273/292
5,531,448 A 7/1996 Moody
5,591,081 A * 1/1997 Suzuki ..... 463/13
5,692,755 A * 12/1997 Gutierrez ..... 273/292
5,732,950 A 3/1998 Moody
5,823,873 A 10/1998 Moody
5,823,874 A 10/1998 Adams
5,848,932 A 12/1998 Adams
5,882,261 A 3/1999 Adams
5,908,353 A * 6/1999 Andrews ..... 273/292
5,911,418 A 6/1999 Adams
5,957,774 A * 9/1999 Holmes et al. ..... 273/292
5,976,016 A 11/1999 Moody et al.
6,007,066 A 12/1999 Moody
RE36,739 E * 6/2000 Gutierrez ..... 273/292
6,089,569 A * 7/2000 Trucksess ..... 273/292
6,089,978 A 7/2000 Adams
6,098,985 A 8/2000 Moody
6,120,378 A 9/2000 Moody et al.
6,227,969 B1 * 5/2001 Yoseloff ..... 273/143 R
6,334,613 B1 * 1/2002 Yoseloff ..... 273/274
6,336,860 B1 * 1/2002 Webb ..... 463/16

* cited by examiner

*Primary Examiner*—Jessica Harrison
*Assistant Examiner*—Alex F. R. P. Rada, II
(74) *Attorney, Agent, or Firm*—James A. Wanner, Esq.

(57) ABSTRACT

The method of the present invention is directed to a poker card game, preferably a video card game such as played on a computer screen or in a video poker machine such as found at a casino, wherein on a single wager the poker player plays a face down hand, called a card back hand, and a face up poker hand. The card back hand, played either prior to or after playing the face up hand, is a random dealt hand and, if winning criteria are met, establishes a payout greater than the normal payout on preselected winning face up poker hands. This increases the potential payout on a given poker wager, while using a standard poker deal and playing method for the face up poker hand.

26 Claims, 16 Drawing Sheets

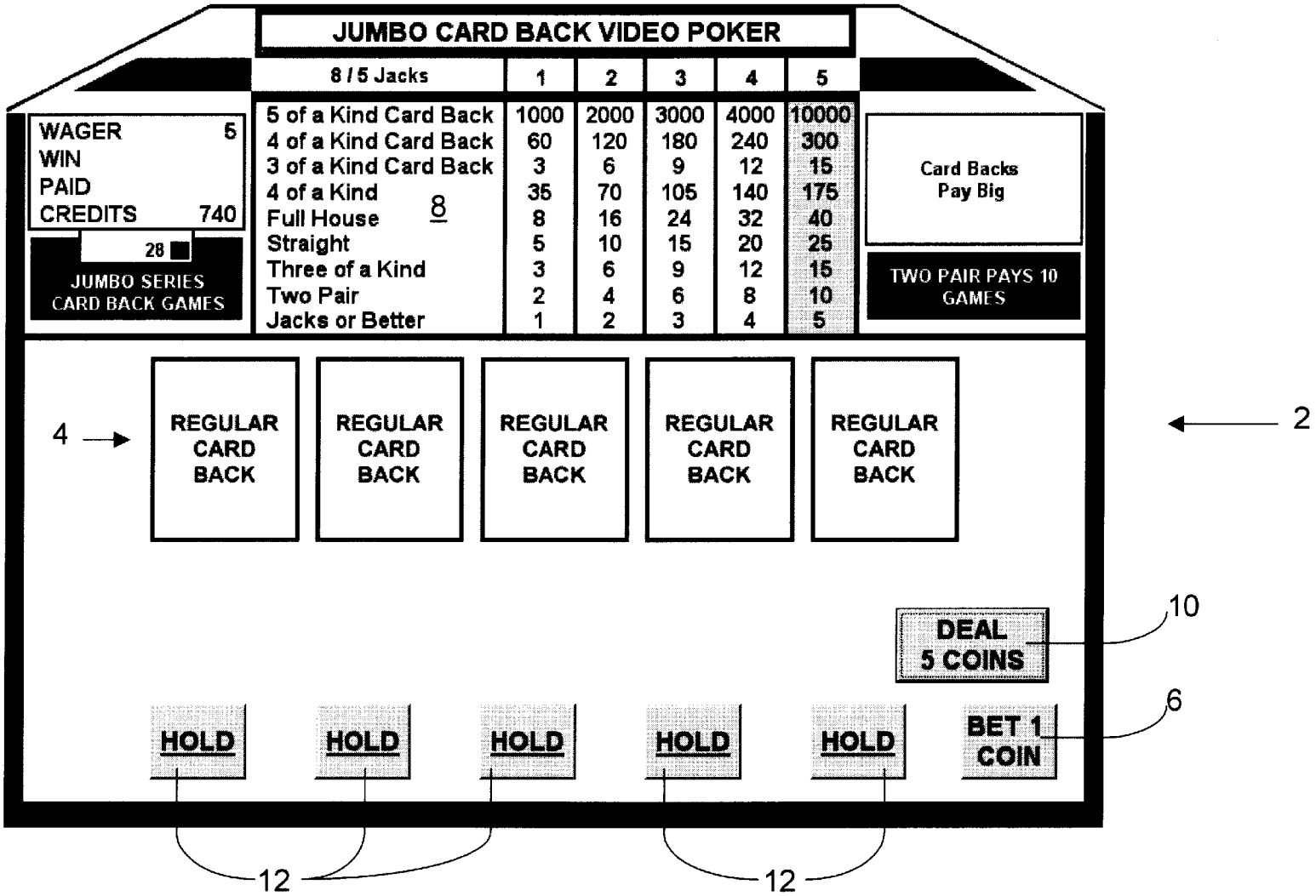
FIG 1-A

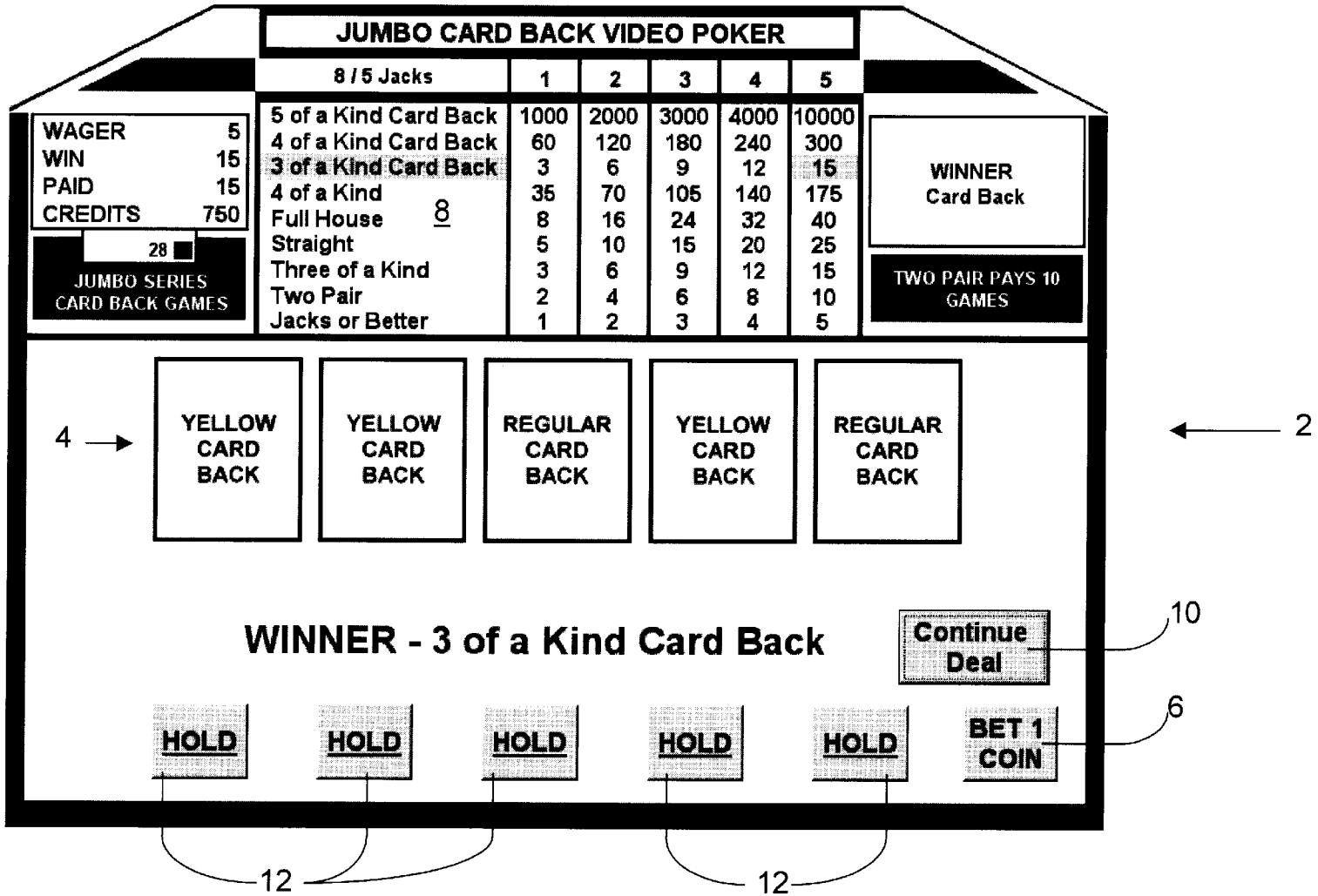
FIG 1-B

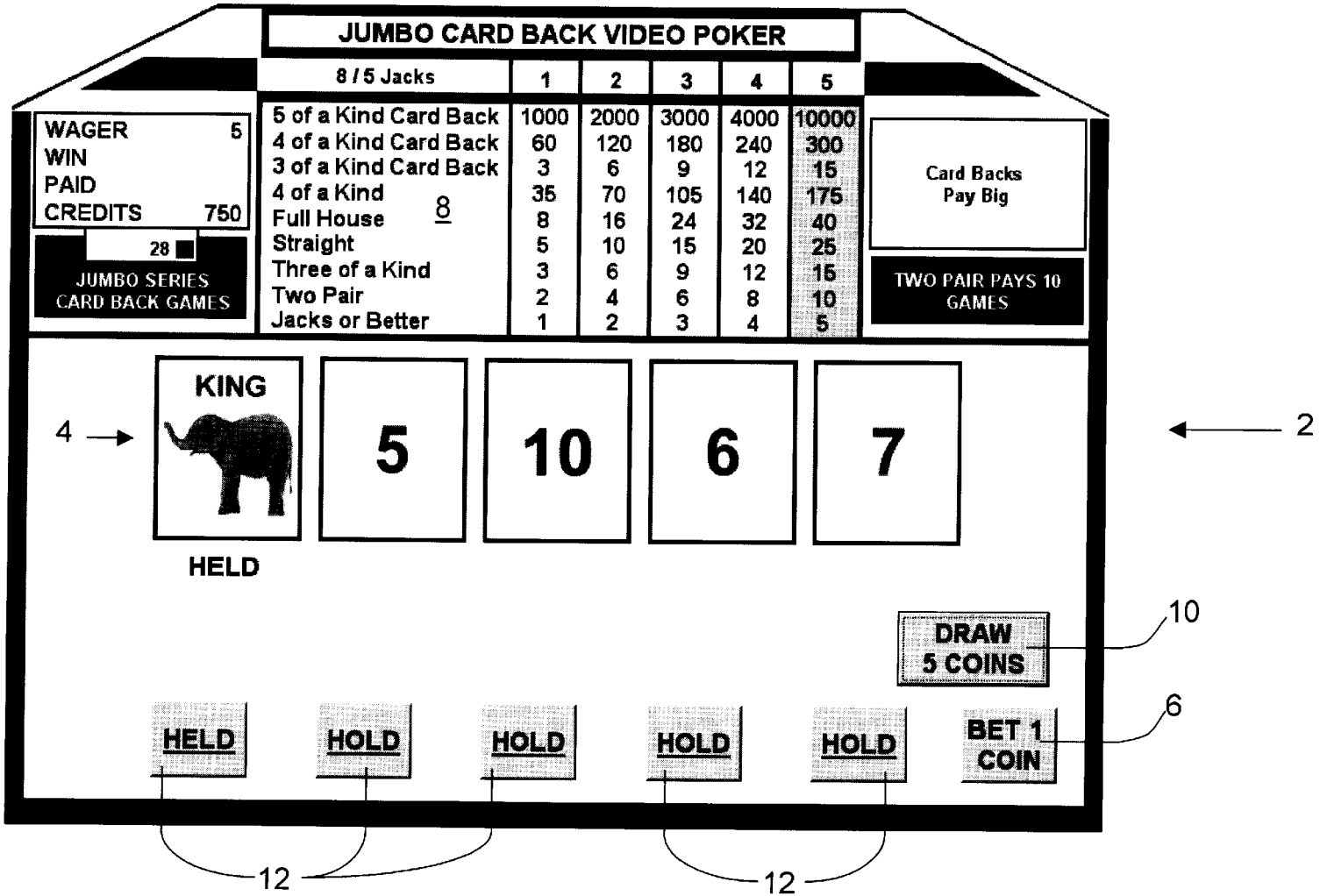
FIG 1-C

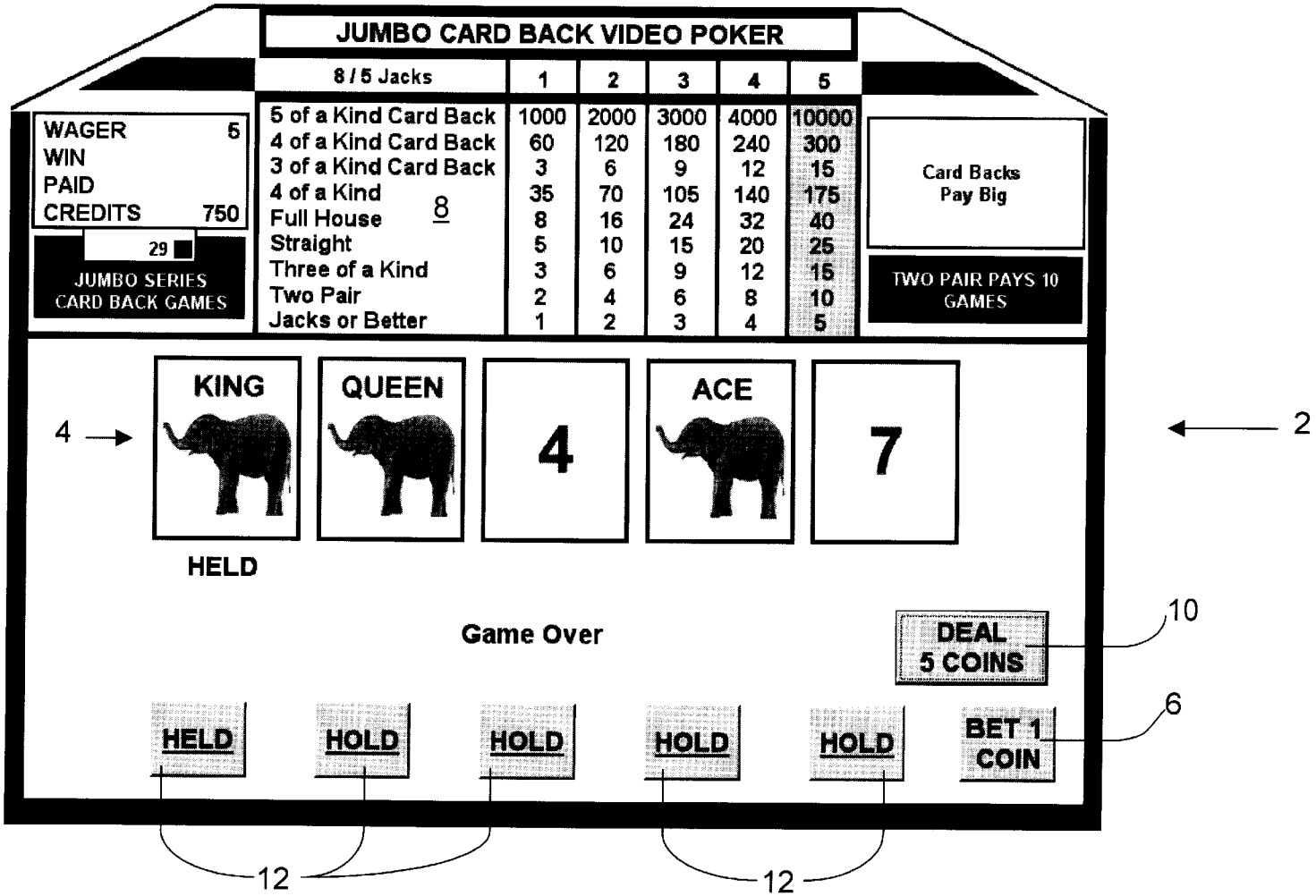
FIG 1-D

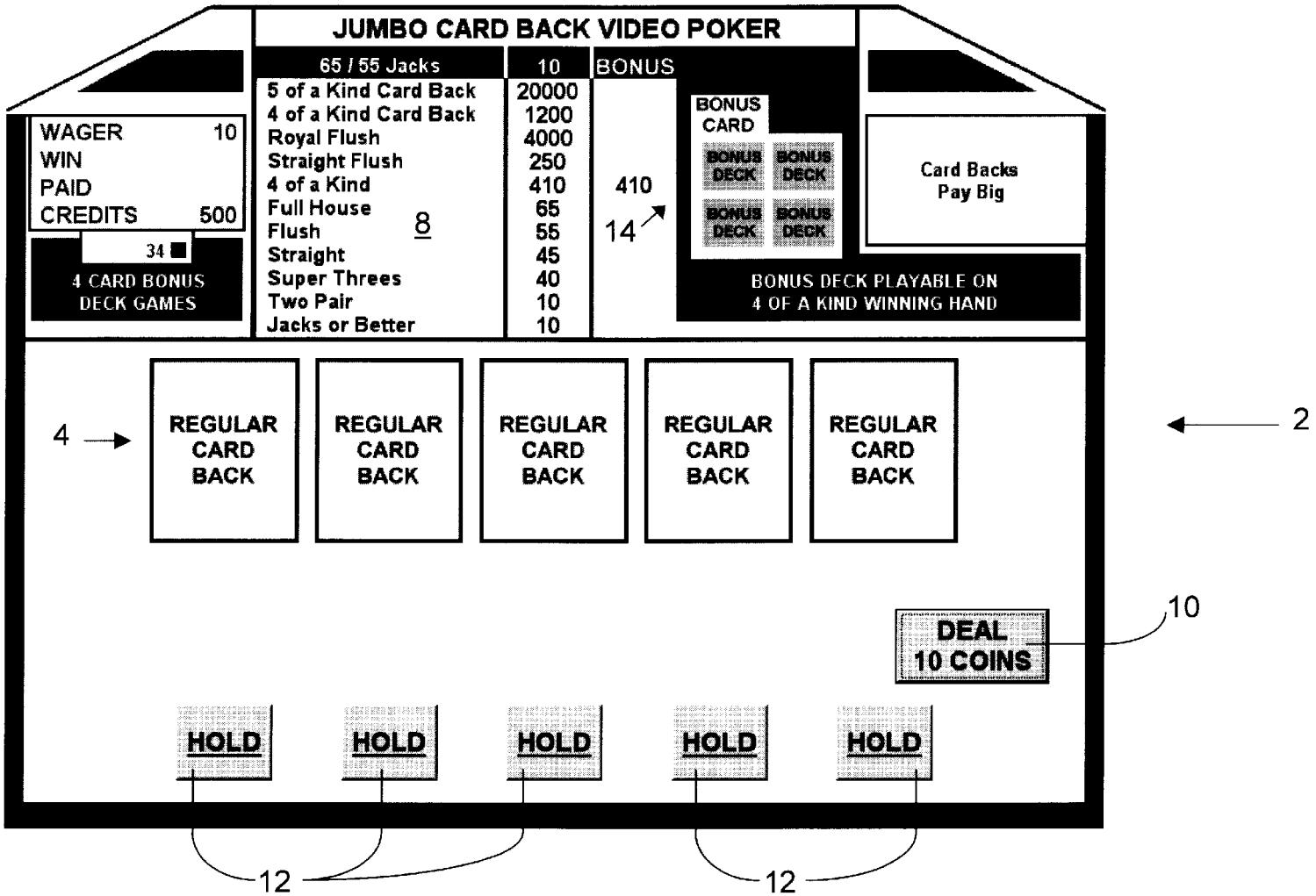
FIG 2-A

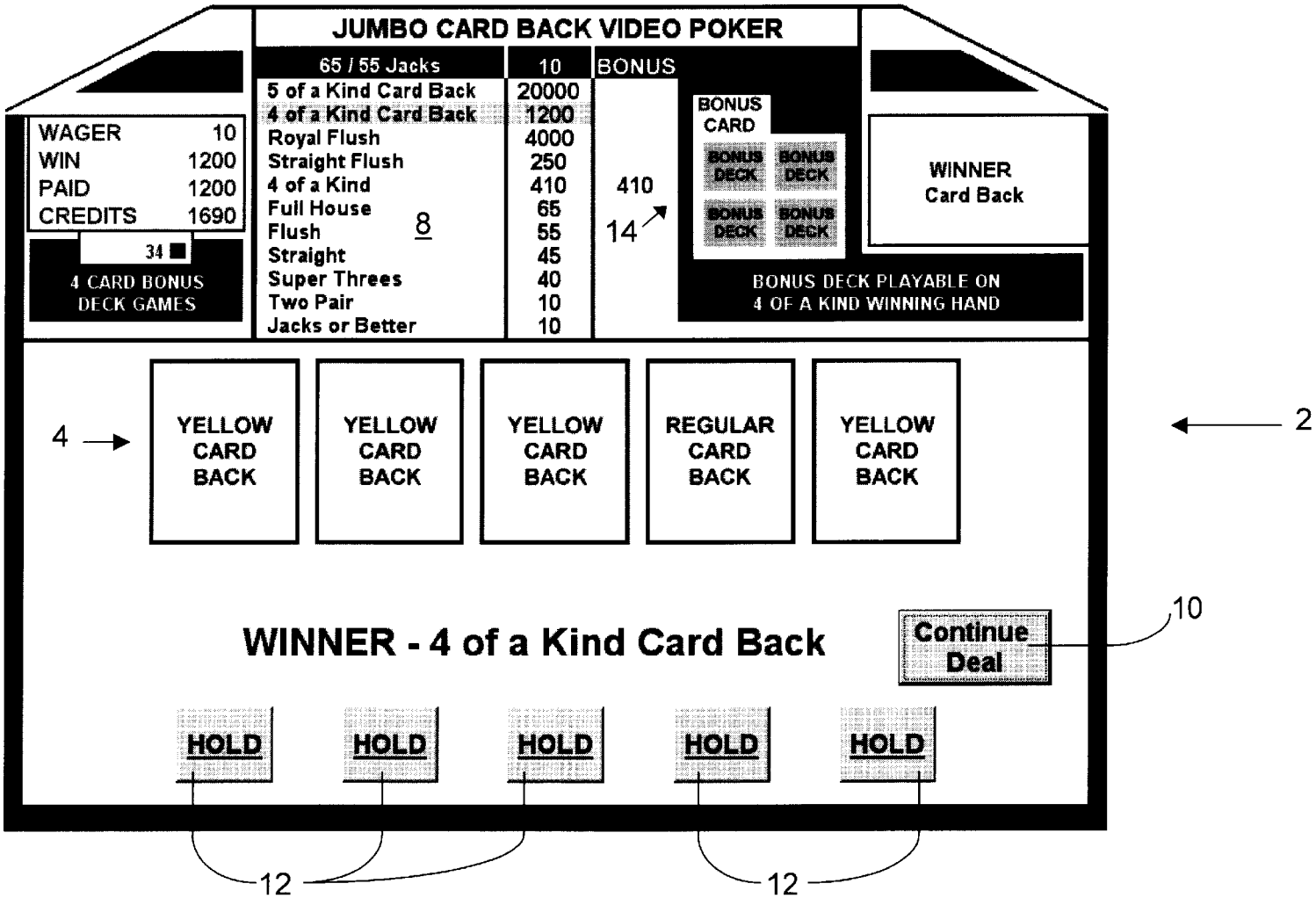
FIG 2-B

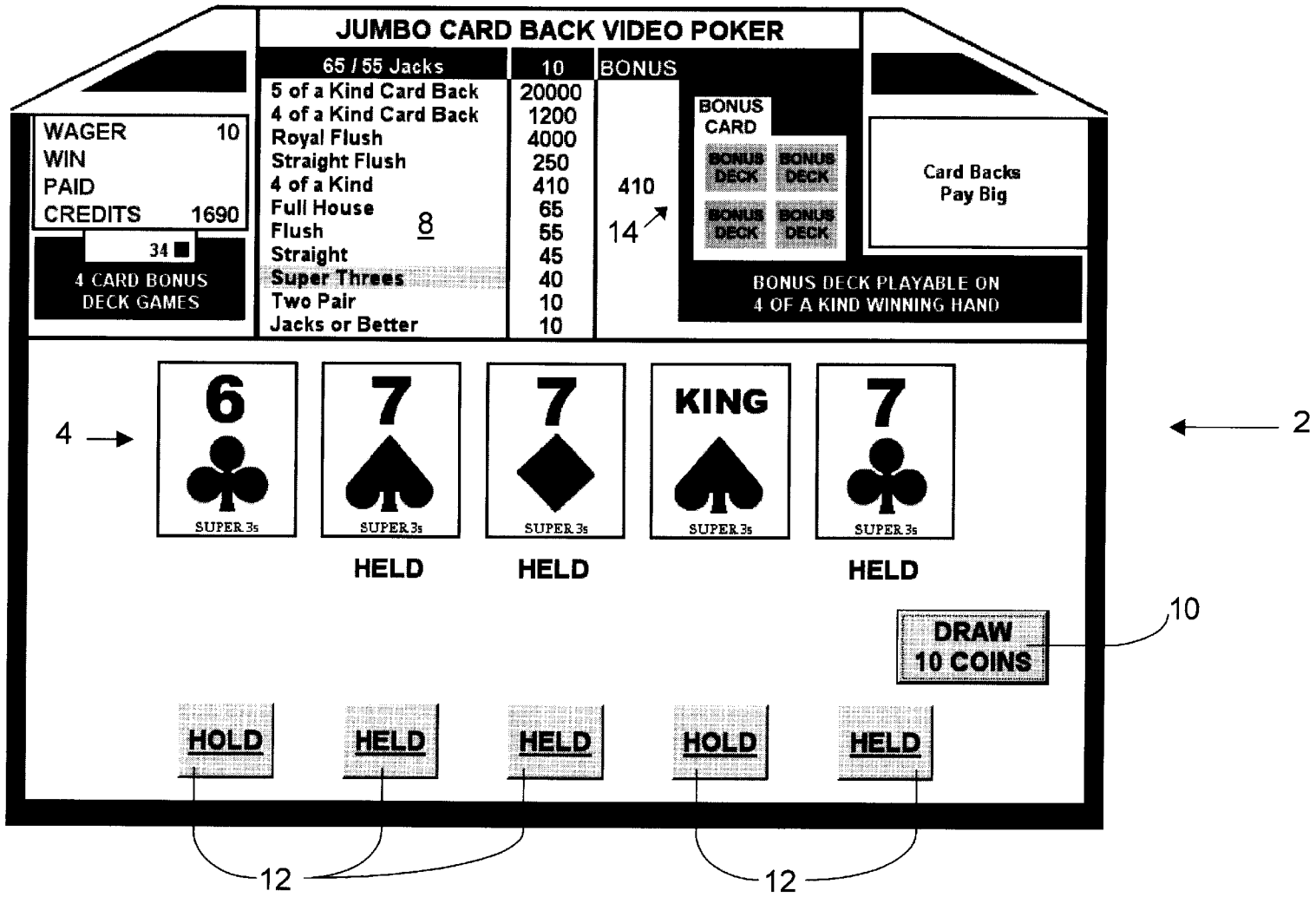
FIG 2-C

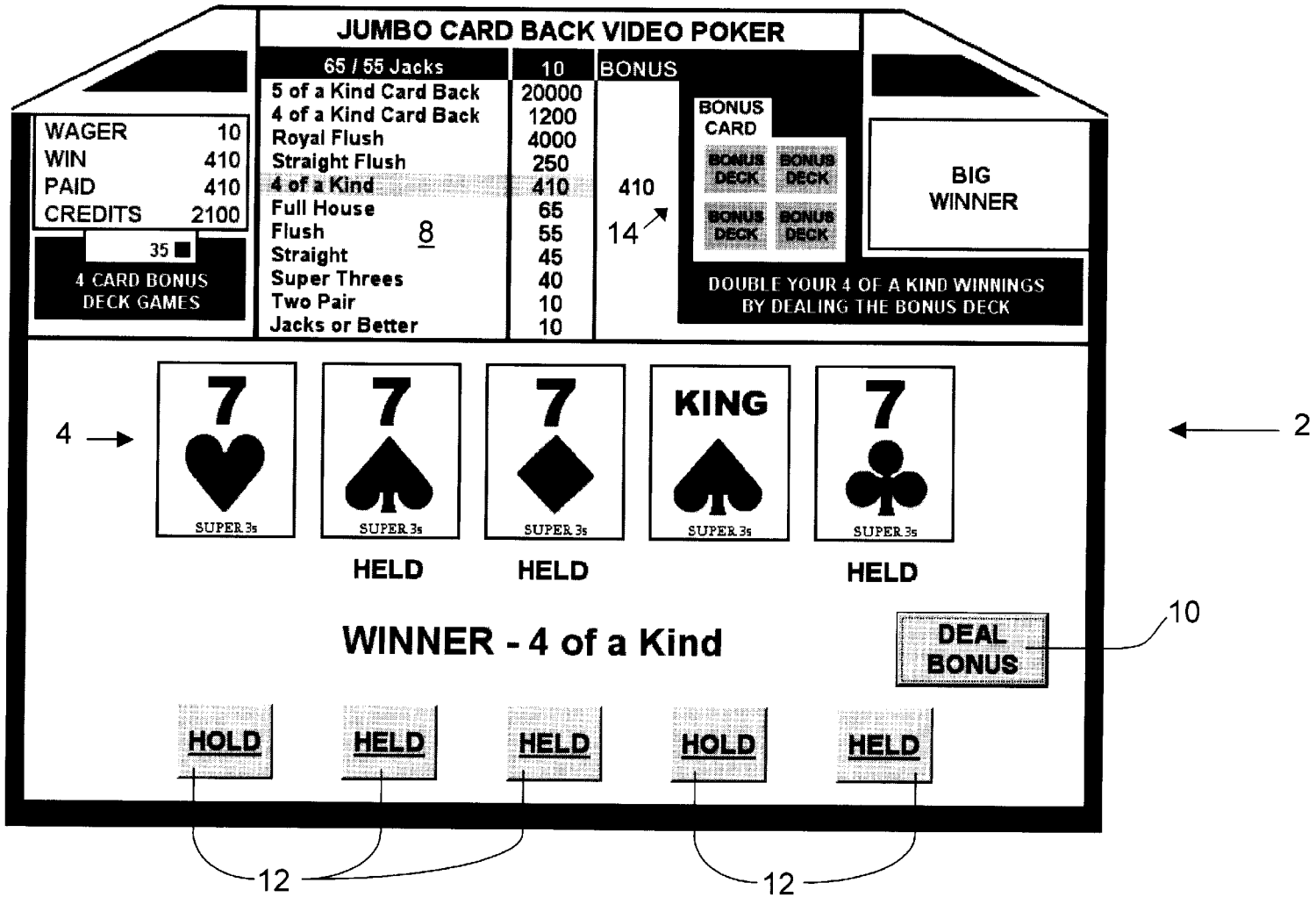
FIG 2-D

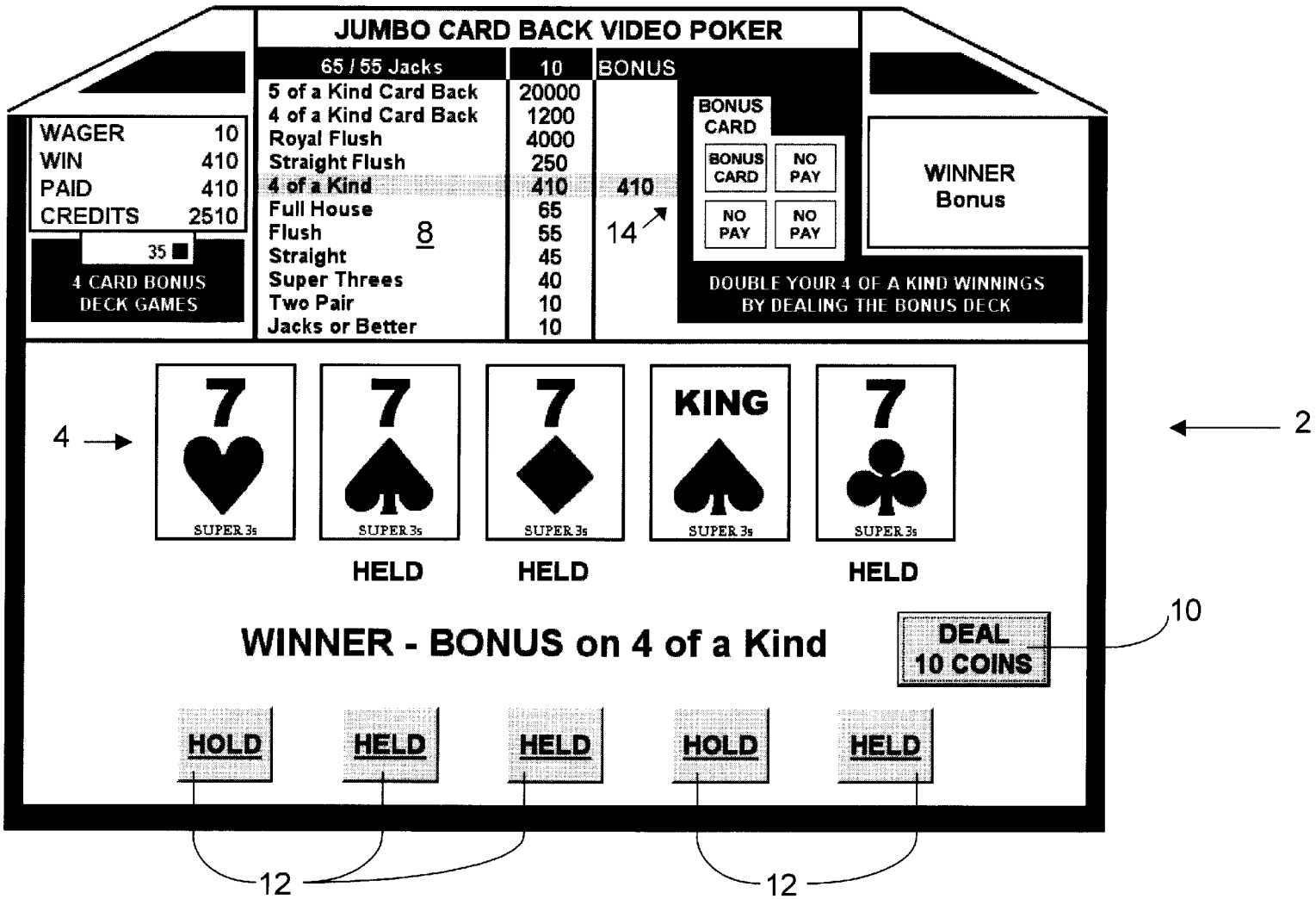
FIG 2-E

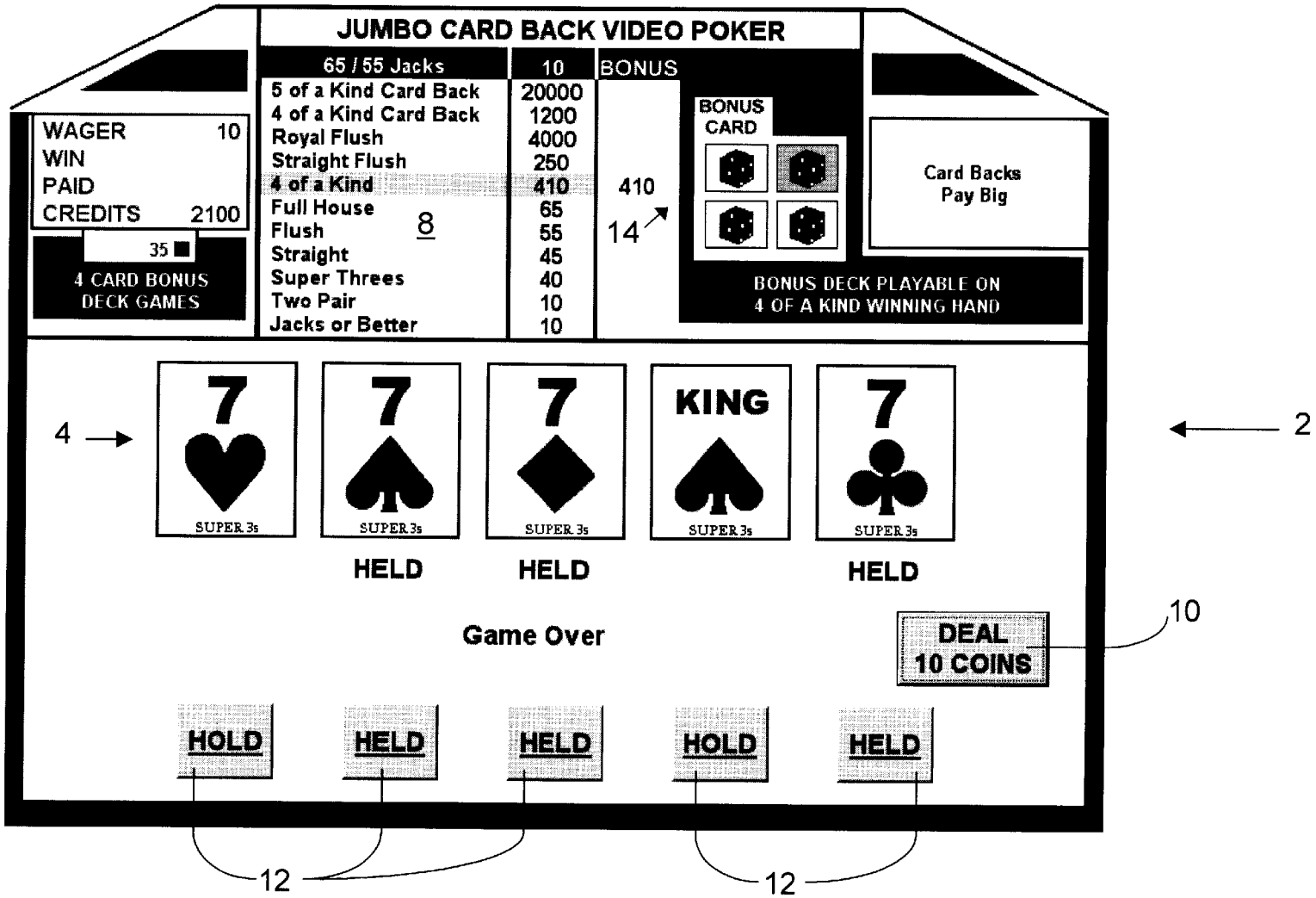
FIG 2-F

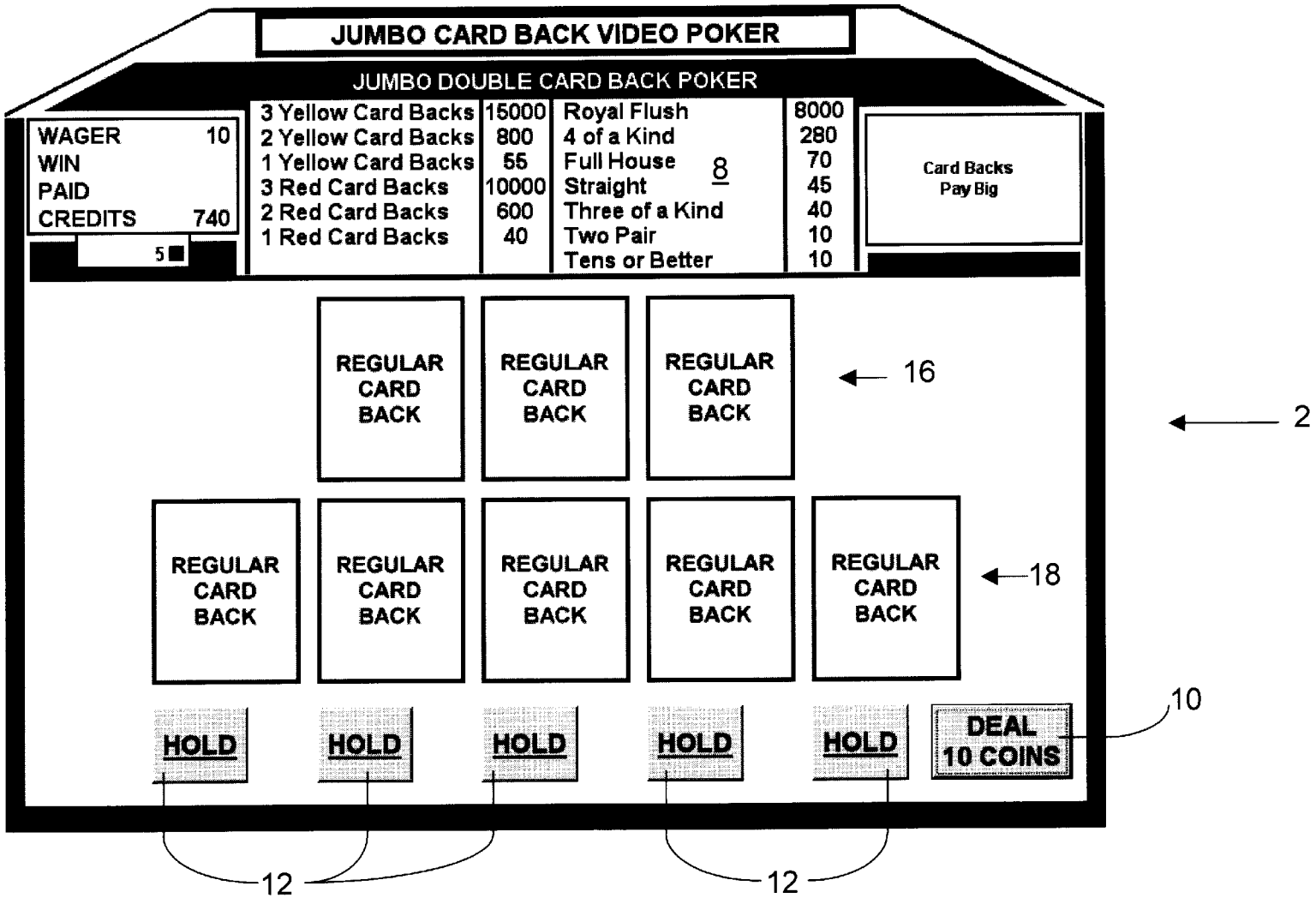
FIG 3-A

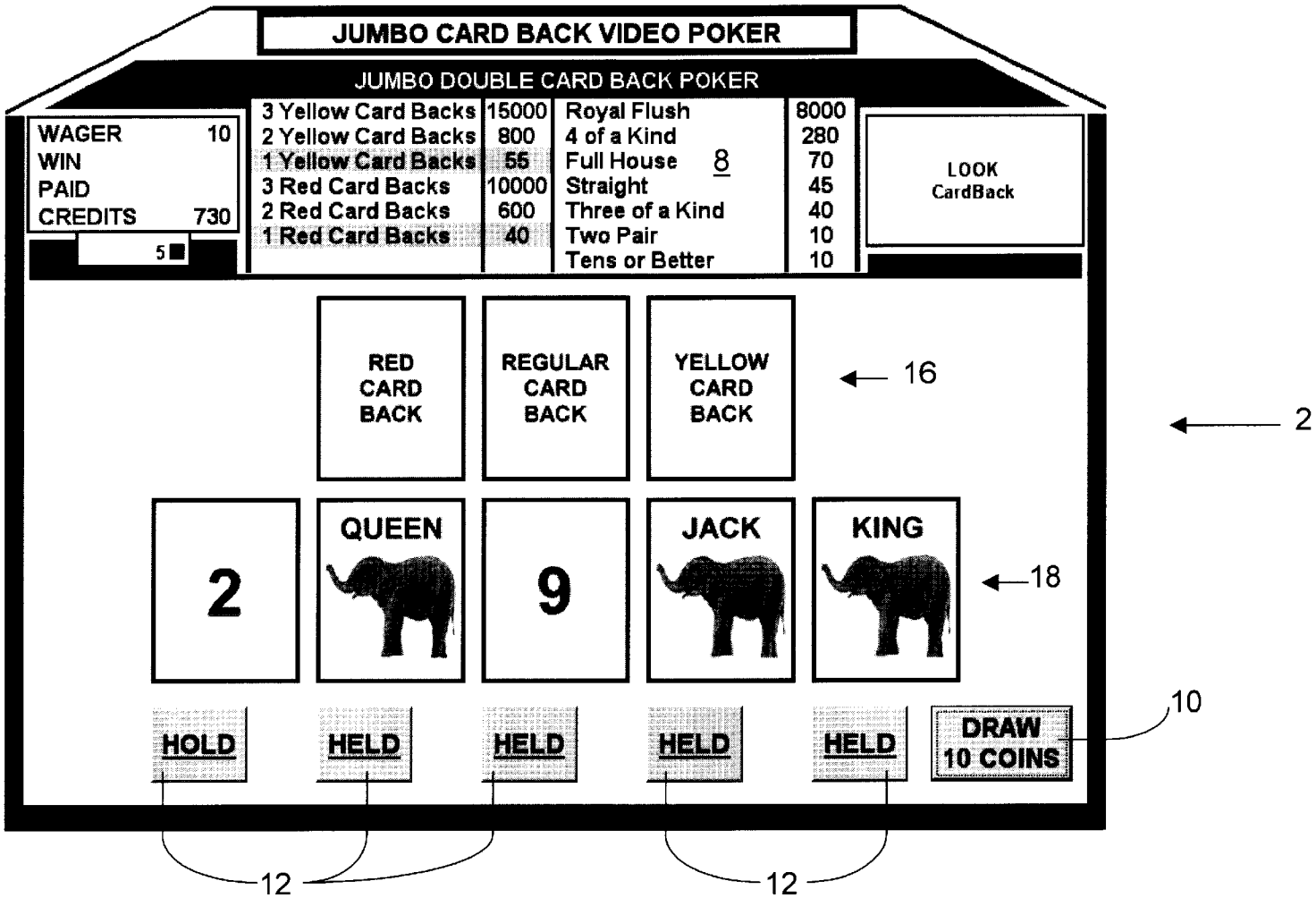
FIG 3-B

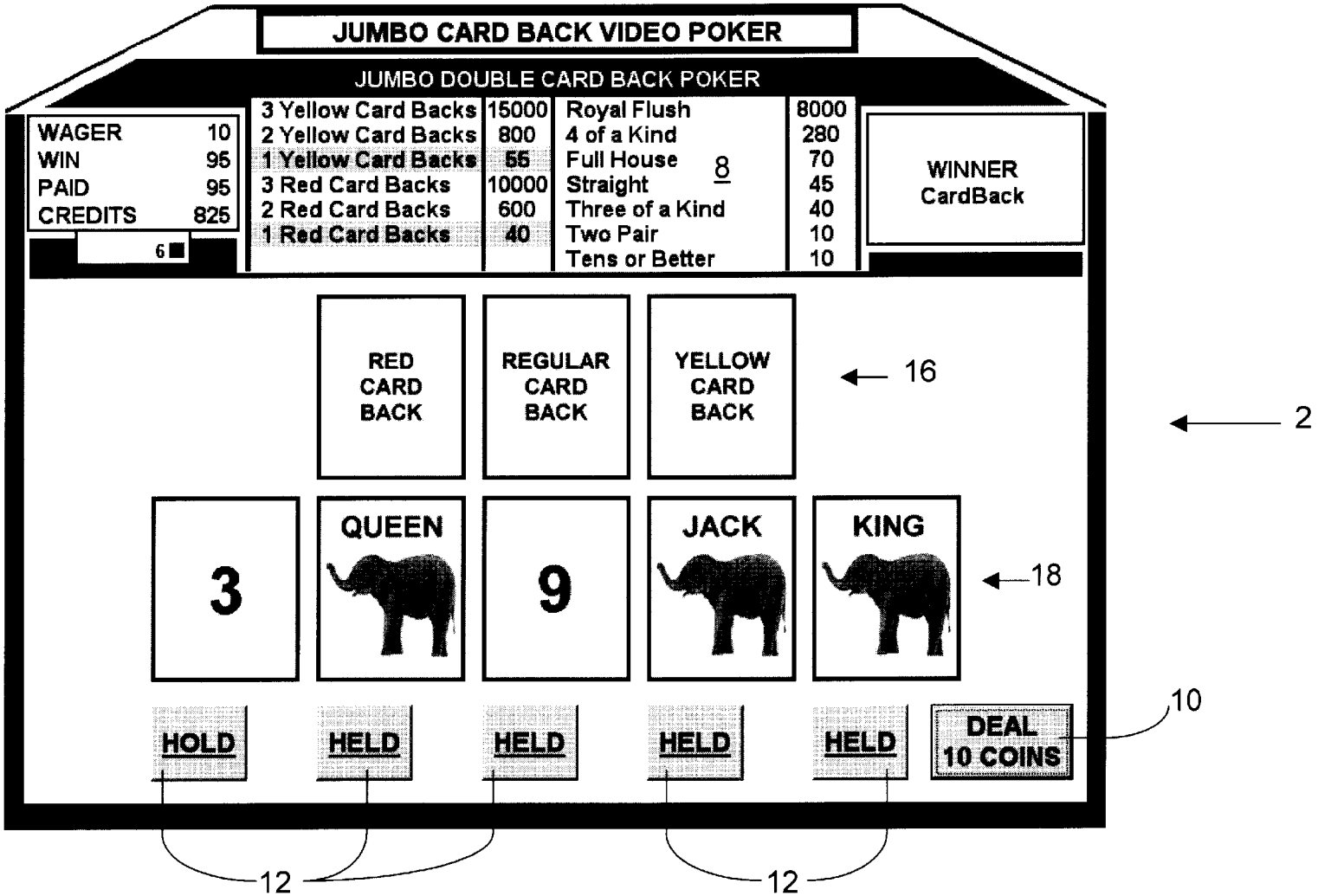
FIG 3-C

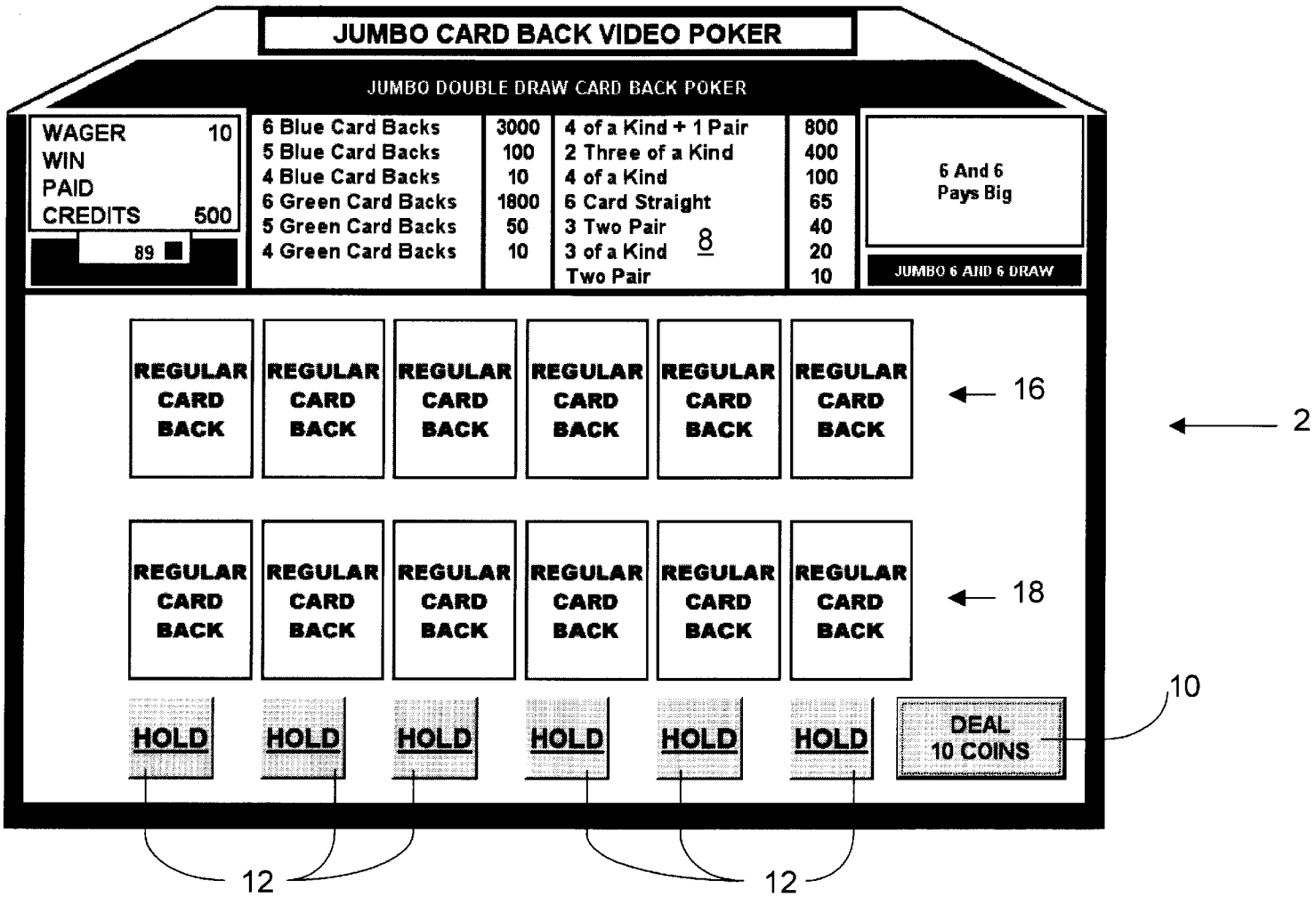
FIG 4-A

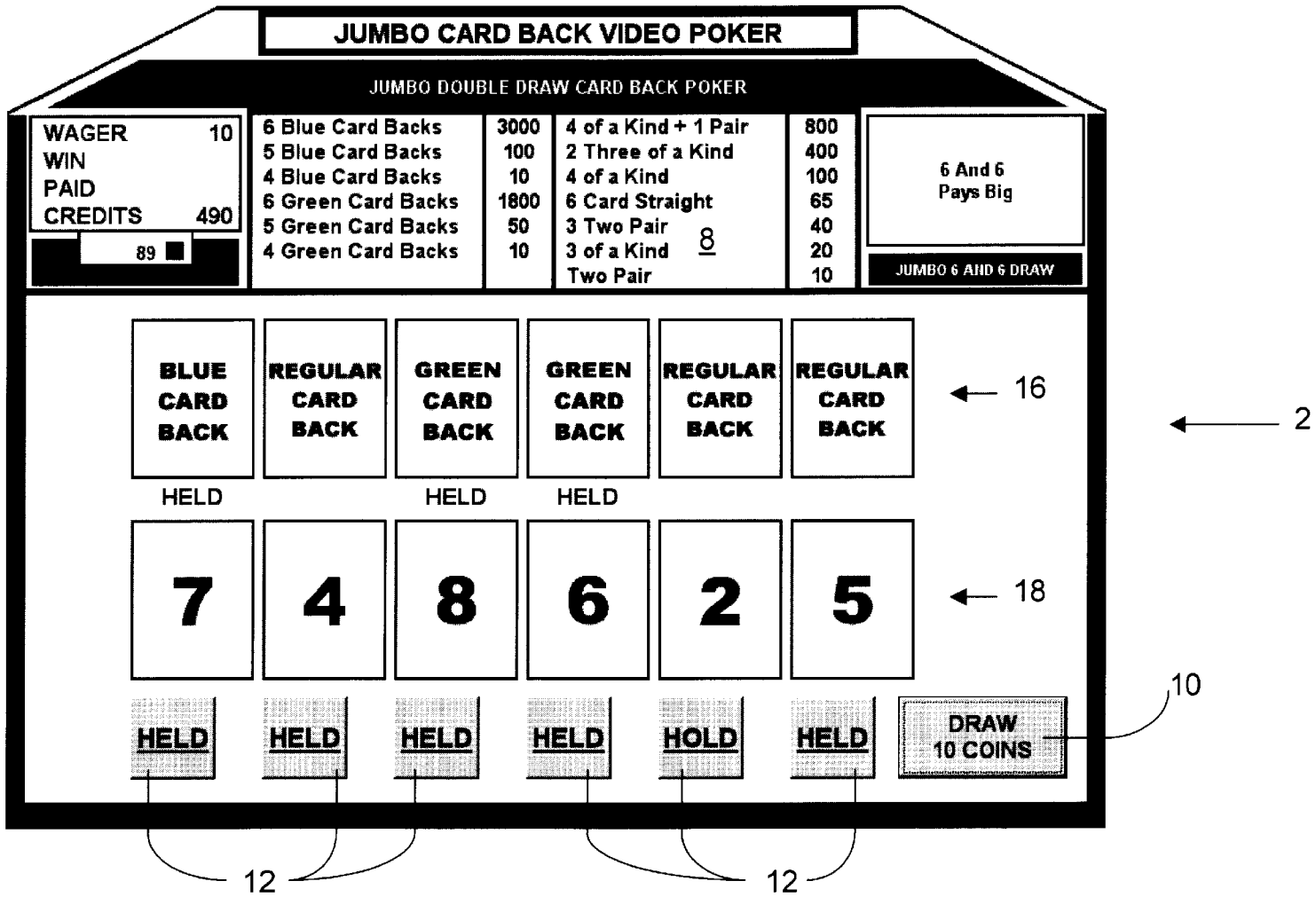
FIG 4-B

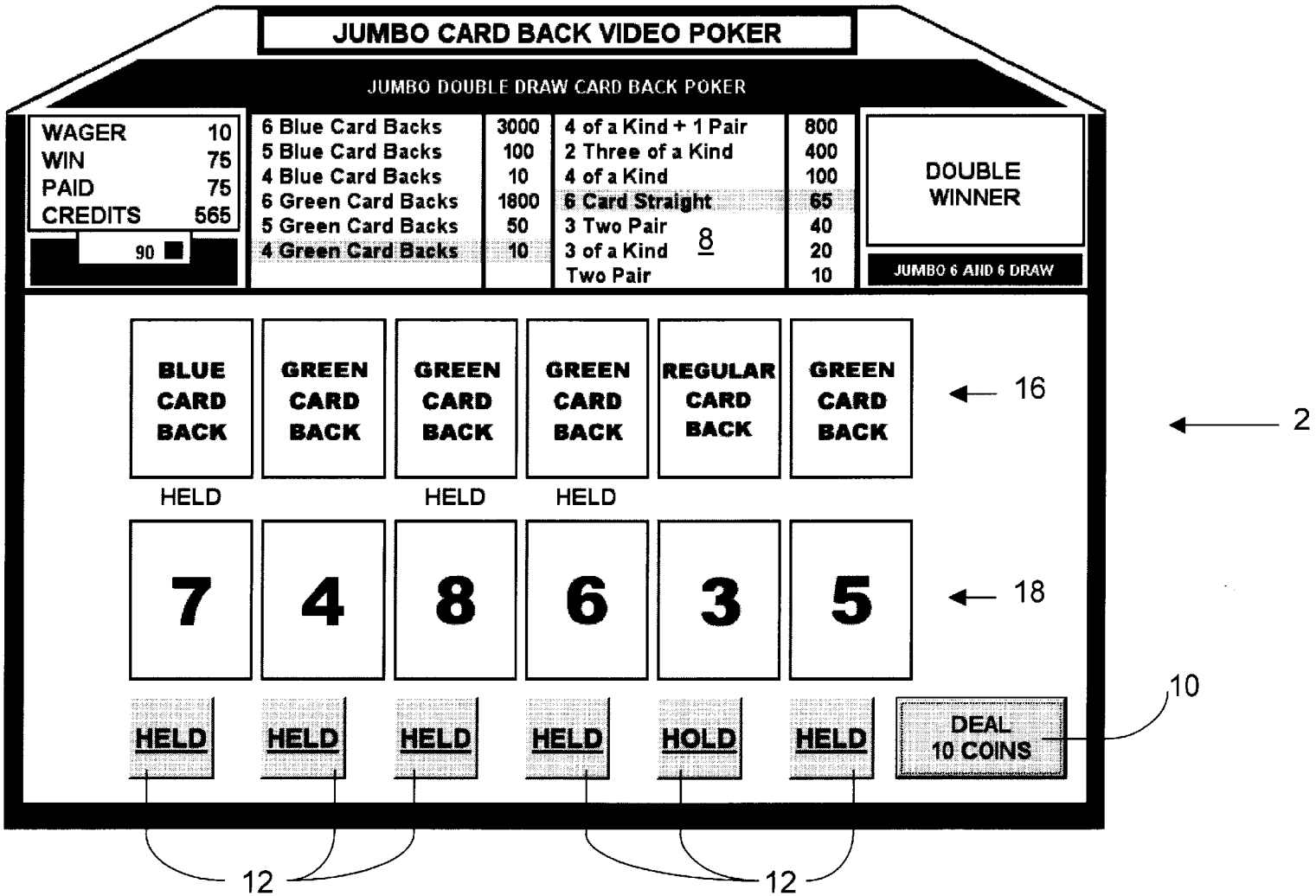
FIG 4-C

METHOD OF PLAYING A POKER GAME WITH CARD BACK HANDS

BACKGROUND OF THE INVENTION

With the many video poker games that are available today, it is desirable to increase the interest of the game player. The more players that can be drawn to a game, and the longer that they stay at the game, means more activity for the casino operator who is always trying to increase the total amount wagered. The attractiveness of the game also results in more poker machines sold by the manufacturer of the gaming device or the more CDs that can be sold for use on home computers. One major way to increase the attractiveness of the poker game to the game player is to increase the payout, or at least the perceived payout, that can be received for any given "bet".

The present invention relates primarily to electronic video poker games, and more particularly to electronic video poker games that are based on poker hand rankings with a predetermined payout schedule. The present invention is applied to any poker game, such as draw poker or straight poker, with any number of cards such as from three to seven cards, with or without wild cards.

The present invention has many versions with the common thread being that for any given single wager, there are two or more random deals, one of which is a face up deal from 52 cards for a normal poker hand and a separate random deal with the card backs facing up deal from a deck of either 52 cards, or a lesser number or cards or other devices, and for which the player normally has no interactive play. The random card back deal provides a hand of card backs, some of which may include a "winning" indicia or symbol, which if the symbol appears in a predetermined number or in a specific location, establishes a card back payout. The card back hand deal, separate from the normal poker deal, establishes a separate payout in addition to the payout for certain face up winning poker hands. Since there is the possibility for a payout from the poker hand plus the possibility of a substantial payout from the card back hand, there is an increased interest by the player. While the present invention is especially applicable to video poker games, the invention also involves features that may apply to table poker games as well.

SUMMARY OF THE INVENTION

One method of the present invention introduces a poker game that in effect for a single given bet provides two deals, one with a face up hand from a deck of 52 cards as in normal poker, and a separate random deal with a face down hand, referred to herein as a card back hand, or some other card back bonus deal including the potential for increased payouts. In one version of the present invention, the card back up hand is a random deal from 52 cards and is separate from the face up hand. The card back up hand, normally without any player interaction, provides a payout that is from a predetermined statistical table based upon the number of payout symbols that appear of the card back hand. In another version of the present invention, the card back or bonus deal can be from a deck of less than 52 cards, or in a video game a deal of a predetermined number of die. The payout from either the card back hand or bonus deal is stored and applied in the poker pay table that is established for the normal poker face up hand. It is particularly noted that the face up poker hand is dealt from a deck of 52 cards and is played the same as standard poker games such as five card draw, seven card stud, etc. Thus the game player is not required to learn a new form of poker that could prevent some players from attempting the new game. However at the same time the poker player gets a separate face down deal, or bonus deal, which requires no interaction on the player's part, but which can substantially increase the payout from the single given wager.

The present invention includes a method of playing a poker card game comprising selecting a wager for the poker card game, randomly dealing a poker hand of three or more cards all having the card faces up, determining the poker hand ranking and establishing a poker hand payout from a preestablished table providing a payout for various poker hands, from a number of cards having a predetermined number of the card backs having a payout symbol, randomly dealing a card back hand of at least three cards all having the card backs up, establishing a card back payout determined by the number of the card backs in the card back hand having the payout symbol or by the location of a card back having the payout symbol, storing the card back payout and the poker hand payout, and determining a final payout taking together the card back payout and the poker hand payout.

BRIEF DESCRIPTION OF THE DRAWINGS

FIG. 1-A shows the screen display for a Card Back, no Bonus Deck play, draw poker game version of the present invention prior to the play of the hands at the start of the deal.

FIG. 1-B shows the screen display for a Card Back, no Bonus Deck play, draw poker game version of the present invention prior to the play of the poker hand, but after the play of the card back hand.

FIG. 1-C shows the screen display for a Card Back, no Bonus Deck play, draw poker game version of the present invention during the play of the poker hand.

FIG. 1-D shows the screen display for a Card Back, no Bonus Deck play, draw poker game version of the present invention after the draw of the poker hand.

FIG. 2-A shows the screen display for a Card Back, with Bonus Deck play, draw poker game version of the present invention prior to the play of the hands at the start of the deal.

FIG. 2-B shows the screen display for a Card Back, with Bonus Deck play, draw poker game version of the present invention prior to the play of the poker hand, but after the play of the card back hand.

FIG. 2-C shows the screen display for a Card Back, with Bonus Deck play, draw poker game version of the present invention during the play of the draw poker hand.

FIG. 2-D shows the screen display for a Card Back, with Bonus Deck play, draw poker game version of the present invention after the draw of the poker hand.

FIG. 2-E shows the screen display for a Card Back, with Bonus Deck play, draw poker game version of the present invention after the play of the poker hand, and showing a winning position of the card back bonus play.

FIG. 2-F shows the screen display for a Card Back, with Bonus Deck play, draw poker game version of the present invention after the play of the poker hand, and showing a losing position of the card back bonus play, and with a colored die representing the payout symbol.

FIG. 3-A shows the screen display for a Card Back, no Bonus Deck play, draw poker game version of the present invention, with the number of cards in the card back hand being different from number of cards in the poker hand and in two different display lines, and with two card back indicia, prior to the play of the hands at the start of the deal.

FIG. 3-B shows the screen display for a Card Back, no Bonus Deck play, draw poker game version of the present invention, with the number of cards in the card back hand being different from number of cards in the poker hand and in two different display lines, and with two card back indicia, during the play of the draw poker hand.

FIG. 3-C shows the screen display for a Card Back, no Bonus Deck play, draw poker game version of the present invention, with the number of cards in the card back hand being different from number of cards in the poker hand and in two different display lines, and with two card back indicia, after the draw of the poker hand.

FIG. 4-A shows the screen display for a Card Back, no Bonus Deck play, draw poker game version of the present invention, with the card back hand and the poker hand in two different display lines, and with two card back indicia, prior to the play of the hands at the start of the deal.

FIG. 4-B shows the screen display for a Card Back, no Bonus Deck play, draw poker game version of the present invention, with the card back hand and the poker hand in two different display lines, and with two card back indicia, during the play of the draw poker hand.

FIG. 4-C shows the screen display for a Card Back, no Bonus Deck play, draw poker game version of the present invention, with the card back hand and the poker hand in two different display lines, and with two card back indicia, after the draw of the poker hand and automatic draw of the card back hand.

DETAILED DESCRIPTION OF THE PREFERRED EMBODIMENTS

The present invention is directed to a method, including many submethods, of playing a poker game wherein a single wager can result in obtaining a substantially greater payout than that normally obtained in the normal play of the poker game. The greater payout is obtained by actually playing two or more hands for the single wager. While the poker game can be played with a standard deck of playing cards on a table, the poker game of the present invention is especially adapted for play as an electronic video game either on a video gaming device such as at a casino or on a computer video screen. The poker game, based on a single wager, actually includes a standard poker hand plus a separate randomly dealt hand with the card backs up, referred to herein as the card back hand.

The poker hand, randomly dealt from a deck of 52 cards, has its own payout determined by a poker hand rating and a predetermined payout schedule or table. The poker hand can be any recognized poker card game of three or more cards such as five card draw, seven card stud, or any other poker game, with or without wild cards, normally played as a video poker game. This eliminates the need for the player to learn to play a special form of poker. Furthermore, for purposes of simplicity, the poker hand is ranked on a preestablished poker payout table as has been standard in previous video poker games. The poker hand is provided with a poker hand payout as established by the poker hand payout table.

The separate card back hand is randomly dealt with the card backs facing up. Payout for the card back hand is determined by the location, after the card back hand deal, of a least one of the card back hand cards having the payout symbol. In one preferred version, the card back hand is also dealt from a deck of 52 cards, but with a predetermined number of the card backs having a "winning" or payout symbol or indicia which can be either a special picture or a special color so as to distinguish the card back bearing the payout symbol from the card backs not having the payout symbol. If a preselected number of card backs bearing the payout symbol appear in the card back hand dealt, then the player is awarded a card back payout as also established and presented in the payout table for the poker game. In another preferred version, called the Bonus Deck Play in the examples given, the card back hand is dealt from a limited number of cards or bonus deck, only one of which has the payout symbol, and such single card back must occur in a special predetermined location for the player to be a card back winner. In the second version, it is particularly desirable to only be able to play the card back hand if a winning poker hand, posted on the payout table, is first obtained.

The particular advantage to the poker game of the present invention is that the player, on a given wager, has two or more chances to win. This creates a higher potential payout for the single wager and thus greater attractiveness to the player. Of course the payout tables must be modified in a manner so as to maintain the total payout for both the potential poker hands and the potential card back hands to be the same as for standard electronic video poker games. The methods of playing the card back hands will be obvious after referring the Examples given below.

EXAMPLE #1

Card Back, no Bonus Deck Equal Number of Face Cards and Card Backs Shown in FIGS. 1-A to 1-D This particular Example #1 of the poker game involves five-card draw for the poker hand and also five cards in the card back hand. First the card back hand is played and displayed on line 4 centered on the screen display 2. As the poker hand is later played it will also be displayed in a similar manner on line 4 in the center of the screen 2. FIG. 1-A shows the display at the beginning of the hand. Line 4 displays five regular card backs as play has not started. The player selects the size of the wager by hitting button 6, which is the BET button, for the number of times, one to five, that he chooses for the size of the wager. If the player does not hit button 6, the default wager is 5 coins. On a home video game the wager is placed by clicking the mouse on the button 6. Once the wager is placed, no further wager is placed until the game is finished and the next game is started.

Pay particular note to the payback table 8 shown near the top of the screen 2. The bottom six lines of the payout table are for potential five card poker hands and show the various rankings and payouts for such poker hands. The top three lines of the payout table 8 display the payouts for potential card back hands. The payout table has five columns to show the various payouts depending on the number of coins bet. In the game of this Example #1, the card back deck consists of 52 cards of which most have a "Regular Card Back", but anywhere between five to eight of the card backs will have a special indicia or payout symbol, which for this particular deck is a "Yellow Card Back". The payouts for the card back hands displayed will vary depending on the number of Yellow Card Backs in the card back deck. This is established when the game designer determines the payout schedule. Thus the card back hand payout will depend on the number of card backs in the deck that have the payout symbol and the number of cards in the card back hand that display the payout symbol, which in this case is the "Yellow Card Back." Of course an indicia or payout symbol other than a "Yellow Card Back" can be used, such as the symbol of an elephant or other device; however a the term "Yellow Card Back" is used in the example to simplify the drawings.

After selecting the amount of the wager, the player hits button 10, which is now the DEAL button, to initiate play of the card back hand. In the particular game of this Example #1, the player was lucky and drew three "Yellow Card Back" cards as shown on line 4 of FIG. 1-B. If he drew zero, one or two Yellow Card Backs, he would receive no card back hand payout. But in this example, he would get a card back hand payout of 3 to 15 coins depending on how many coins were wagered. This is also shown in FIG. 1-B.

After playing the card back hand, without placing another wager, the player then hits button 10, which now reads "Continue Deal". A five card poker hand, with the card faces up, now appears on line 4 of screen 2 as seen in FIG. 1-C. If the poker game is five card draw, the player may hold cards in the standard manner by hitting the particular HOLD button 12 under the card or cards to be held. The buttons 12 which have been hit now read HELD. The player again hits button 10, now labeled DRAW, to draw cards to replace the face up poker cards not held. In some video poker games, rather than having hold buttons 12, the player can hold a card by clicking on the card itself or by touching the screen at the location of the card. Here the player is not so lucky, and he gets a wash out poker hand with no additional payout as seen in FIG. 1-D.

Therefore the player gets no payout for the poker hand, but because he bet 5 coins (see FIG. 1-A), he does get a 15 coin payout for the card back hand (see FIG. 1-B). Because the player does get some payout, even though he lost the poker hand, he has more interest in the game. The poker machine is now ready for the next game with a new wager and new deals of both the card back hand and the poker hand.

EXAMPLE #2

Card Back, with Bonus Deck Equal Number of Face Cards and Card Backs Shown in FIGS. 1-A to 1-D The poker game of Example #2 is similar to the game of Example #1 in that again it is five-card draw for the poker hand and a five-card card back hand. However in this Example #2, the card back hand from the Bonus Deck is also used. In the example shown, the wager is automatically 10 coins and thus there is no button 6 by which to place the amount of the wager. Note that the payout table only has one column representing a wager of 10 coins. Again FIG. 2-A represents the screen before the game begins with five normal card backs showing. Upon hitting the DEAL button 10, the player was again extremely lucky and got four "Yellow Card Backs" as seen in line 4 of FIG. 2-B. Note that the card back hand payout is 1200 coins as shown in the second to the top line of the payout table 8. It is this potential of extremely large payouts that stimulates interests in the card game of the present invention.

The player then hits the button 10 which now reads "Continue Deal" and gets a poker hand of three 7's which provides a potential poker hand payout of 40 coins as seen in FIG. 2-C. The player hits the respective three HOLD buttons 12 to hold the three 7's, and hits the button 10 that now reads DRAW. The player obtains a fourth 7 as seen in FIG. 2-D which provides an actual poker hand payout of 410 coins. This is indeed fortunate, as the player now has obtained the right to play the Bonus Deck. Note in FIGS. 2-A through 2-F there is a bonus number in the "Bonus" column for "4 of a Kind", but for no other poker hand. Thus the player needed to hit a 4 of a Kind poker hand in order to be able to play the Bonus card back hand.

In order to play the Bonus Card hand, the player again hits the button 10 that now says DEAL BONUS. In the example, four card backs are shown in the Bonus Deck section 14. For this Example #2, four card back bonus cards are used but the number may be larger. One, and preferably only one, of the bonus card backs has a special indicia or symbol, but there are only as many bonus cards as the number of squares provided in the Bonus Deck section 14. The object is to have the random draw of the four cards in this Example #2 result with the bonus card back with the special symbol end up in the square in the upper left corner of the Bonus Deck section. In FIG. 2-E, the player ends up with the "Bonus Card" card back in the upper left corner and with "No Pay" card backs in the other three bonus card squares. Thus he wins a card back or bonus payout of another 410 coins. In FIG. 2-F, the "Bonus Card" ends up in a square outside the upper left corner of the bonus card section 14, and there is no card back payout. In this Example #2, with four card backs in Bonus Card play and with only one having the special symbol, there is a 25% chance of receiving the bonus card back payout in addition to the poker hand payout for the "4 of a Kind" poker hand. When a larger number of bonus cards are provided for and dealt, such as 13 or 50 bonus card backs, the payout odds are smaller, but the payout for winning the bonus deal card back hand is greater.

While three "No Pay" bonus cards and one "Bonus Card" bonus card is shown in the Figures of this Example #2, in a normal poker game with the bonus deck feature, a more appealing card back would be used. For example, three of the bonus card card backs could be green and show a die, while the bonus card back having the payout symbol would also show a die, but would be red. This is represented in the Bonus section 14 of FIG. 2-F with the red card back with a die being shown in the upper tight corner and shaded to represent the red color. Of course many other variants are possible. Also note that in this Example #2, that there is the card back deal such as shown in Example #1, then the poker hand deal, and then the Bonus Deck deal only if the proper poker hand is obtained. Of course it is possible to have the Bonus Deck deal, based upon the results of the poker hand, without using the first card back deal.

EXAMPLE #3

Card Back, no Bonus Deck Different Number of Face Cards and Card Backs Two Different Card Backs Shown in FIGS. 3-A to 3-C The poker card game is similar to the card game of example #1 in that there is no Bonus card back game after playing the poker game; however, it is also similar to the card game of Example #2 in that there is an automatic play of ten coins as can be seen by the DEAL button 10 and the poker table 8 in the video screen 2 of FIG. 3-A. However there are three differences in the poker game of Exhibit #3. First the card back game is displayed in a line 16 that is separate from the display of the poker game in line 18. Another distinction is that the card back game only has three cards, which is different from the number of cards in the draw poker game that in the example is five cards.

The third distinction is that instead of only one winning indicia or symbol for the card backs, there are two distinct indicia or symbols for the card backs, namely a "Yellow Card Back" and a "Red Card Back" as can be seen in the left column of the payout table 8 in FIGS. 3-A, 3-B and 3-C. In this Example #3, there is a card back payout for even one "Yellow" or "Red" card back as there are only three chances to obtain a colored card back. A deal of three card backs of a given color provides a very high card back payout since again there are only three chances. The card back payout for "Yellow" card backs is higher than for "Red" card backs since in the deck of 52 card backs there is one more "Red" card back than "Yellow" card backs, thus making it more difficult to obtain a "Yellow" card back.

The play of the poker game in Example #3 is similar to the play of the poker game of Example #1, but without the player determining the number of coins wagered. The game starts with only "Regular Card Backs" showing in both lines 16 and 18 of screen 2. After hitting the DEAL button 10, a card back hand appears in line 16 and a poker hand appears in line 18. As an alternative, at the beginning of the game, only line 18 with the card backs for the poker hand appears; and only after the deal is made by hitting DEAL button 10, does line 16 for the card back hand appear. Since the player obtained one "Red" and one Yellow" card back in the card back hand of line 16, he will receive, at the end of the game, a card back payout of 40 coins and another card back payout of 55 coins as is highlighted in the left column of payout table 8 in FIG. 3-B. Since he has a 9 and three face cards in the poker hand displayed in line 18 for a potential straight, the player hits the four HOLD buttons 12 for the Queen, 9, Jack and King, and then proceeds with the draw by hitting button 10 that now reads DRAW. He is not lucky in the draw and still does not have a winning poker hand as seen in FIG. 3-C. However, the player still receives the 40 coins and the 55 coins that he won in the card back hand. This is a very satisfactory winning for the 10 coins wagered that the player would not have received in a normal video poker game.

EXAMPLE #4

Card Back, no Bonus Deck Equal Number of Face Cards and Card Backs Card Back Draw Shown in FIGS. 4-A to 4-E The poker game of Example #4 has no Bonus Deck, there is no selection on the amount of the wager as it is automatically 10 coins, but there is a different twist in that both the poker hand and the card back hand have the draw feature. Also both hands have six cards. As in Example #3, there are two display lines 16 and 18 with line 16 displaying the card back hand and line 18 similarly displaying the poker hand. Also as in Example #3, there are two different indicia or symbols on the card backs, but in this Example #4, the winning indicia is either a "Blue" or a "Green" card back. However, the play is similar to that described in the previous examples.

Again in FIG. 4-A, at the beginning of play, both lines 16 and 18 of screen 2 show "Regular Card Backs". Upon hitting the DEAL button 10, both a card back hand appears in line 16 and a poker hand appears in line 18 as seen in FIG. 4-B. However in this Example #4, the player hits the HOLD buttons 12 for the poker cards reading 7, 4, 8, 6 and 5 in line 18 (but not the HOLD button 12 for the poker card reading 2) as the player is trying to get a 6 Card Straight. Note the change for FIG. 4-A to FIG. 4-B wherein the HOLD buttons 12 for these five face-up cards have changed to HELD. The player then hits the button 10 which now reads DRAW. This provides a 6 Card Straight for the poker hand in line 18 with a poker hand payout of 65 coins as seen in the right column of payout table 8 in FIG. 4-C. When the draw is made for the poker hand, the software automatically draws three card backs for the cards in line 16 reading "Regular Card Backs". The software knows to hold the "Blue" and "Green" card backs without any player intervention because these are winning card backs. This results in two extra "Green Card Backs" as seen in FIG. 4-C for a "4 Green Card Backs" payout of 10 coins. Thus, the player "draws" cards for the poker hand in line 18 by selecting the correct buttons 12, but the game automatically "draws" the cards for the card back game in line 16. Note that both the poker hand and the card back hand payouts are different, and relatively low, as compared to other Examples. This is because there are six cards in play in both the poker hand and the card back hand, and the card back game has the automatic draw feature.

The attractiveness of the poker game of the present invention is that the player can receive extremely large payouts from a single wager. This can be seen in the payout tables of Examples #1 and #2 for "5 of a Kind Card Back" hand and in the payout table of Example #3 for a "3 Yellow Card Backs" hand. While these payouts are large, the odds of obtaining such hands depend on the number of card backs having the payout symbol, and the odds of obtaining such hands are quite small. When setting up the card game software and payout tables, the game designer must determine the odds for each poker hand and card back hand in the various scenarios. Even though the odds of some card back hands is quite small, since the payout is so large, it is necessary to adjust the payouts for various poker hands so that the total payout does not exceed the coins wagered. One method or doing this is shown in Examples #1, #3, and #4. As distinguished from the poker hand cards of Example #2 where the poker card faces have both a suite indicia and a rank indicia, in these three Examples there are no suite indications on the poker hand card faces. Without a suite indication on the card faces in these three Examples, it is impossible to have a flush, straight flush or a royal flush. Therefore there is no poker hand payout for any flush poker hand. This leaves payout potential for the winning card back hands.

From the four Examples provided above, it is seen that there are many variants available in the play of the poker card game of the present invention. The features from the various Examples can be combined to provide other versions of the combined poker hands and card back hands and the Examples provided are just four of the many versions of the game that are possible. It is noted that in all the examples that the card back hand payout is added to the poker hand payout. As an alternative, the payout schedule can be arranged so that the card back hand payout is used as a multiplier of the poker hand payout. The object is to provide to the player, with a single wager, a potential payout from the combined poker hands and the card back hands that is a much larger jackpot or payout from normal poker games.

The above description of the preferred embodiments, and the Examples provided, are considered illustrative only, rather than limiting. Various modifications and additions may be made and will be apparent to those skilled in the art. As but one example, it is foreseen that in the future, games of this type may be voice activated. Accordingly, the invention should not be limited by the forgoing description, but rather should be defined by the following claims.

What is claimed is:

1. A method of playing a poker card game comprising the steps of:

a) selecting a wager for said poker card game;

b) randomly dealing a face up poker hand of three or more cards all having the card faces up;

c) establishing a face up poker hand payout determined by a preestablished table displaying a payout for various poker hands;

d) from a deck of cards having substantially identical card backs but with a number of said card backs having a first payout symbol, said number falling within the range of one to the number of cards in the face up poker hand plus three, randomly dealing a card back hand of two or more cards all having the card backs up;

e) establishing a card back hand payout determined by the occurrence of at least one of said card backs in said card back hand having said payout symbol; and f) determining a final payout taking together said card back hand payout and said poker hand payout.

2. The method of playing a poker card game of claim 1 wherein said card back hand is dealt prior to the dealing of said poker hand.

3. The method of playing a poker card game of claim 1 wherein the cards of said card back hand are dealt from a deck of fifty-two cards and the number of card backs having said payout symbol being at least equal to the number of cards dealt in said card back hand.

4. The method of playing a poker card game of claim 1 further including the steps of:

a) selecting none, one or more of the face up cards from said poker hand as cards to be held; and b) discarding from said poker hand the cards that were not selected to be held and replacing each of those cards with another face up card from the same deck.

5. The method of playing a poker card game of claim 4 wherein said poker hand is played as a draw poker hand with the poker cards to be held being selected by the player of the poker game, and wherein said card back hand is also a draw hand with the card back cards to be held being automatically selected from the cards displaying said card back payout symbol.

6. The method of playing a poker card game of claim 1 wherein said card back hand is displayed in a similar manner as said poker hand.

7. The method of playing a poker card game of claim 1 wherein said card back hand payout is established by the number of card backs displayed which bear said payout symbol.

8. The method of playing a poker card game of claim 7 wherein the cards of said card back hand are dealt from a deck of fifty-two cards and the number of card backs having the payout symbol at least equal to the number of cards dealt in said card back hand.

9. The method of playing a poker card game of claim 1 wherein cards of said card back hand are dealt from a deck of a limited number of cards with one and only one card back has the payout symbol, and to obtain the winning payout the card with said payout symbol must appear in a predetermined position.

10. The method of playing a poker card game of claim 9 wherein the cards of said card back hand is dealt after said poker hand is dealt and said card back hand is dealt only if said poker hand is of a ranking meeting predetermined criteria.

11. The method of claim 1 including the additional step of displaying the potential payouts of said card back hand in a payout table that also displays the potential payouts of said poker hand.

12. A method of playing a poker card game comprising the steps of:

a) selecting a wager for said poker card game;

b) from a deck of cards having substantially identical card backs but with a number of said card backs having a first payout symbol, said number falling within the range of one to the number of cards in the face up poker hand plus three, dealing a card back hand of at least three cards all having the card backs up;

c) establishing a card back hand payout determined by the number of the card backs appearing with said payout symbol in said card back hand;

d) storing said card back hand payout;

e) randomly dealing a separate poker hand of three or more cards all having the card faces up;

f) establishing a poker hand payout from the cards in said poker hand; and g) determining a final payout taking together said card back hand payout and said poker hand payout.

13. The method of playing a poker card game of claim 12 further wherein the number of cards dealt in said card back hand is different than the number of cards dealt in said poker hand.

14. The method of playing a poker card game of claim 12 wherein the cards of said card back hand are dealt from a deck of fifty-two cards and the number of card backs having said payout symbol being at least equal to the number of cards dealt in said card back hand.

15. The method of playing a poker card game of claim 12 further including the steps of:

a) selecting none, one or more of the face up cards from said poker hand as cards to be held; and b) discarding from said poker hand the cards that were not selected to be held and replacing each of those cards with another face up card from the same deck.

16. The method of playing a poker card game of claim 15 wherein said poker hand is played as a draw poker hand with the poker cards to be held being selected by the player of the poker game, and wherein said card back game is also a draw hand with the card back cards to be held being automatically selected from the cards displaying said card back payout symbol.

17. The method of playing a poker card game of claim 12 wherein the card backs of said deck of cards used to deal said card back hand have more than one payout symbol with the number of card backs having each payout symbol falling within the range of one to the number of cards in the face up poker hand plus three, and the card back hand payout being determined by the number of each card back payout symbol that appear in the card back hand.

18. The method of playing a poker card game of claim 12 wherein said card back hand is displayed on a video screen on a line separate from the display of said poker hand.

19. The method of playing a poker game of claim 12 including the additional step of displaying the potential payouts of said card back hand in a payout table that also displays the potential payouts of said poker hand.

20. A method of playing a poker card game comprising the steps of:

a) selecting a wager for said poker card game;

b) randomly dealing a poker hand of three or more cards all having the card faces up;

c) establishing a poker hand payout determined by a preestablished table displaying a payout for various poker hands;

d) determining a dealing pattern to display said card backs with one position in such display representing a payout position;

e) from a deck of cards with a limited number of cards less than a standard fifty-two card deck with the cards of said deck of cards having substantially identical card backs but with one of said cards having a card back displaying a payout symbol, randomly dealing a card back hand of all of said cards all having the card backs up;

f) establishing a card back hand payout determined by the position of said card back having said payout symbol relative to said payout position of said predetermined dealing pattern; and g) determining a final payout taking together said card back hand payout and said poker hand payout.

21. The method of playing a poker card game of claim 20 wherein the cards of said card back hand are dealt after said poker hand is dealt and said card back hand is dealt only if said poker hand is of a ranking meeting predetermined criteria.

22. The method of playing a poker card game of claim 20 wherein the card backs all represent a die and said payout symbol is a die of a different color than the die represented on the other card backs.

23.The method of playing a poker game of claim 20 including the additional step of displaying the potential payouts of said card back hand in a payout table that also displays the potential payouts of said poker hand.

24. A method of playing a card back card game comprising the steps of:

a) from a deck of cards with a predetermined number of said cards having card backs having at least one payout symbol, randomly dealing a card back hand of two or more cards all having the card backs up;

b) displaying a preestablished table providing a payout for various card back hands; and c) establishing a card back hand payout determined by the occurrence of at least one of the card backs in said card back hand having said payout symbol.

25. The method of playing a card back card game of claim 24 wherein the cards of said card back hand are dealt from a deck of fifty-two cards and said card back hand payout is determined by the number of card backs in said card back hand displaying said payout symbol.

26. The method of playing a card back card game of claim 24 wherein only one of said cards has a card back displaying said payout symbol and said card back hand payout is determined by the location of said card back having said payout symbol relative to a predetermined dealing pattern.

* * * * *